US006062194A

United States Patent [19]

Schwarz

[11] Patent Number: 6,062,194

[45] Date of Patent: May 16, 2000

[54] FUEL INJECTION SYSTEM FOR AN INTERNAL COMBUSTION ENGINE

[75] Inventor: Volker Schwarz, Weinstadt, Germany

[73] Assignee: Daimler Chrysler AG, Stuttgart, Germany

[21] Appl. No.: 09/229,422

[22] Filed: Jan. 14, 1999

[30] Foreign Application Priority Data

Jan. 15, 1998 [DE] Germany ..... 198 01 169

[51] Int. Cl.[7] ..... F02M 39/00

[52] U.S. Cl. ..... 123/299; 123/300; 123/501; 123/506

[58] Field of Search ..... 123/299, 300, 123/500, 501, 502, 506, 446

[56] References Cited

U.S. PATENT DOCUMENTS

| | | | |
|---|---|---|---|
| 3,456,629 | 7/1969 | Dangauthier | 123/299 |
| 4,579,096 | 4/1986 | Kobayashi et al. | 123/299 |
| 4,681,080 | 7/1987 | Schukoff | 123/506 |
| 4,730,585 | 3/1988 | Abe et al. | 123/300 |
| 4,782,803 | 11/1988 | Kikuchi | 123/300 |
| 4,975,029 | 12/1990 | Hatz | 417/494 |
| 4,976,236 | 12/1990 | Brunel | 123/300 |
| 5,168,847 | 12/1992 | Grieshaber et al. | 123/299 |

FOREIGN PATENT DOCUMENTS

| | | |
|---|---|---|
| 31 47 467 | 4/1983 | Germany . |
| OS 36 01 710 | 7/1987 | Germany . |
| OS 37 22 265 | 1/1989 | Germany . |
| 2 110 756 | 6/1983 | United Kingdom . |
| WO 89/00242 | 1/1989 | WIPO . |

*Primary Examiner*—Henry C. Yuen
*Assistant Examiner*—Hein T. Vo
*Attorney, Agent, or Firm*—Klaus J. Bach

[57] ABSTRACT

In a fuel injection system for an internal combustion engine with a fuel injection pump providing for an initial fuel injection and a main fuel injection wherein the fuel injection pump includes a main fuel supply passage section and a side passage and a main fuel control valve disposed in the main fuel supply passage section and an additional control valve arranged in the side passage, at low engine speeds, the main fuel control valve is closed during the initial and main fuel injection periods for generating a pressure sufficient to open a fuel injector nozzle and the additional fuel control valve is opened for reducing the fuel pressure and terminating initial fuel injection and, at high engine speeds, the main fuel control valve is closed during initial fuel injection and again for the main fuel injection.

3 Claims, 5 Drawing Sheets

FUEL INJECTION SYSTEM FOR AN INTERNAL COMBUSTION ENGINE

BACKGROUND OF THE INVENTION

The invention resides in a fuel injection system for an internal combustion engine with an injection pump providing for an initial fuel injection phase and a main fuel injection phase.

Such a fuel injection system is known for example from DE 37 22 265 A1. For the injection of fuel, a piston moving downwardly within an injection pump sucks in fuel by way of a fuel supply line. After closing of a control valve in the fuel injection pump, and with the communication through the line leading from the injection pump through the fuel injector interrupted by the closed fuel injection nozzle needle, the upwardly moving piston generates a high pressure in this line which is also designated high pressure space. As a result of the high pressure generated in this line, the injector's nozzle needle opens and fuel is injected into the combustion chamber of the internal combustion engine.

In addition to the control valve already referred to, the injection pump includes another control valve. One of the control valves is closed during the whole injection period, whereas the other control valve is opened for the termination of the fuel injection procedure.

The injection system described in this patent, however, has the disadvantage that the flow cross-section of the other control valve must be sufficiently large such that the injection procedure can be safely interrupted or, respectively, the initial injection can be terminated at maximum engine speed. However, such a large flow cross-section of the other valve results at a low engine speeds in a disadvantageous excessive pressure release from the high pressure space whereby cavities are formed which, in the end, lead to an unstable main fuel injection process.

Another fuel injection system for internal combustion engines is described in DE 36 01 710 A1. In this case, the flow cross-section of the electromagnetic valve is adjustable in at least two stages and the fuel injection volume is divided into an initial injection volume and a main injection volume. In order to achieve the initial injection, the valve is shortly closed and subsequently opened. It is then again closed for the main injection procedure and subsequently opened to terminate the main fuel injection phase.

With such an injection system, it is disadvantageous that the high pressure space is highly depressurized when the valve is opened at low engine speeds, because of the large flow cross-section of the valve whereby, as described above, cavities are formed which result in an unstable main injection process. Furthermore, during a non-ballistic operation of the magnetic valve, the initial injection volume generated by the pump operated at a relatively high speed is excessively large. Valve hammering occurring in the process, that is seating of the valve member on the valve seat at high speed, result in different injection volumes.

For the general state of the art of fuel injection systems, reference is further made to DE 31 47 467 C1 and to WO 89/00242 A1.

It is the object of the present invention to provide a fuel injection system for an internal combustion engine wherein excessive pressure release from the high pressure space at low engine speeds is avoided and a sufficiently small initial injection volume is provided at high engine speeds.

SUMMARY OF THE INVENTION

In a fuel injection system for an internal combustion engine with a fuel injection pump providing for an initial fuel injection and a main fuel injection wherein the fuel injection pump includes a main fuel supply passage section and a side passage and a main fuel control valve disposed in the main fuel supply passage section and an additional control valve arranged in the side passage, the main fuel control valve is closed at low engine speeds during the initial and main fuel injection periods for generating a pressure sufficient to open a fuel injector nozzle and the additional fuel control valve is opened for reducing the fuel pressure and terminating initial fuel injection and at high engine speeds, the main fuel control valve is closed during initial fuel injection and again for the main fuel injection.

With the control of the initial injection phase by the main control valve at high engine speeds the control duration for the main injection valve is increased that is the valve actuation speed is reduced whereby the influence of valve hammering on the various fuel injection volumes is substantially decreased.

Furthermore, the cross-section of the additional control valve can be made so small that excessive pressure release from the high pressure space of the fuel injection pump during low speed engine operation can be safely avoided. In the lower speed range, the two control valves can then be controlled in the same way as it is known from the state of the art.

Advantageous embodiments of the invention will be described in greater detail on the basis of the accompanying drawings which show the invention and its operation in principle.

DESCRIPTION OF PREFERRED EMBODIMENTS

Figure 1:
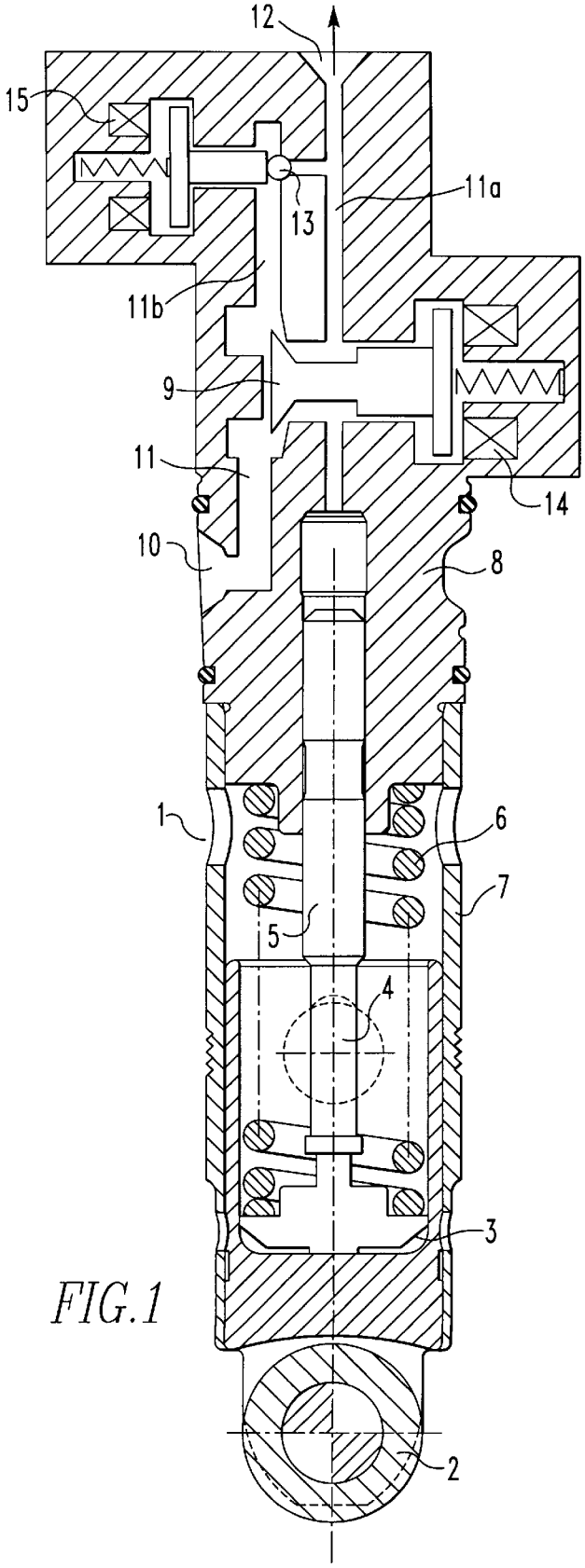
FIG. 1 shows a fuel injection pump for the fuel injection system according to the invention.

FIG. 1 shows a fuel injection pump 1 for an internal combustion engine which is not shown. The design of such an injection pump is well-known. At the bottom end, the fuel pump 1 includes a roller plunger 2, which transmits the impulses applied to it by a cam of a camshaft of an internal combustion engine to a spring plate 3 and by way of a slide ring 4 to a pumping shaft 5 connected to the spring plate 3.

The pumping shaft 5 is resiliently supported by a roller plunger spring 6, all these parts being surrounded by a sleeve 7. At its end opposite the roller plunger 1, the pump shaft 5 is received in a pump housing 8 in which also a main control valve 9 is disposed.

The main control valve 9 is arranged in a fuel supply passage 11 extending from a fuel supply opening 10. The supply passage 11 splits at the control valve 9 into a passage section 11*a*, that is, the main passage 11*a* and a passage section 11*b*, that is, a side passage 11*b*. When the main control valve 9 is open, the fuel supply opening 10 is in communication, by way of the passage section 11*a*, directly with a discharge opening 12, which, by way of a supply line which is not shown, is in communication with a fuel injector which is also not shown. When the main control valve 9 is closed fuel which is not already in the passage section 12*a* can be supplied to the discharge opening 12 only by way of the passage section 11*b* in which an additional valve 13 is disposed.

The flow cross-section of the additional control valve 13 is smaller than the flow cross-section of the main control valve 9 such that the additional control valve 13 is adapted to a predetermined fuel injection flow volume as it is present in the lower engine speed range. However, it is to be taken into consideration that, in contrast to the representation of FIG. 1 which is only schematic, the flow cross-sections are smallest within the control valves 9 and 13, not within parts of the passage sections 11*a* and 11*b*.

When the control magnet 14 of the main control valve 9 is energized the control valve 9 isolates the passage section 11*a* whereas the passage section 11*b* is opened when the control magnet of the additional control valve 13 is energized.

In principle, the injection procedure followed by the injection pump 1 is as follows: driven by the roller plunger spring 6, the pump shaft 5 moves downwardly and sucks in fuel by way of the supply opening 10 and the fuel supply passage 11. Since the fuel is under some pressure, it also enters the main passage 11*a* and the side passage 11*b* and flows toward the opening 12. However, since the pressure in the passage section 11*a* and 11*b* is relatively low the nozzle needle in the respective injection valve does not open.

To initiate fuel injection, the main control valve 9 closes and the pump shaft 5, which is moved upwardly by a cam compresses the fuel in the passage section 11*a* which is also designated high pressure space. As a sufficiently high pressure is generated, the fuel injection valve opens and fuel is injected into the combustion chamber of the engine. When the main control valve 9 or the additional valve 13 is opened the fuel is discharged from the passage section 11*a* back into the fuel passage 11 and out of the injection pump 1.

In order to achieve a relatively small fuel injection volume during initial fuel injection in the method known from the state-of-the-art, the main control valve 9 is closed shortly before the main fuel injection step and is then immediately opened again.

Figure 2:
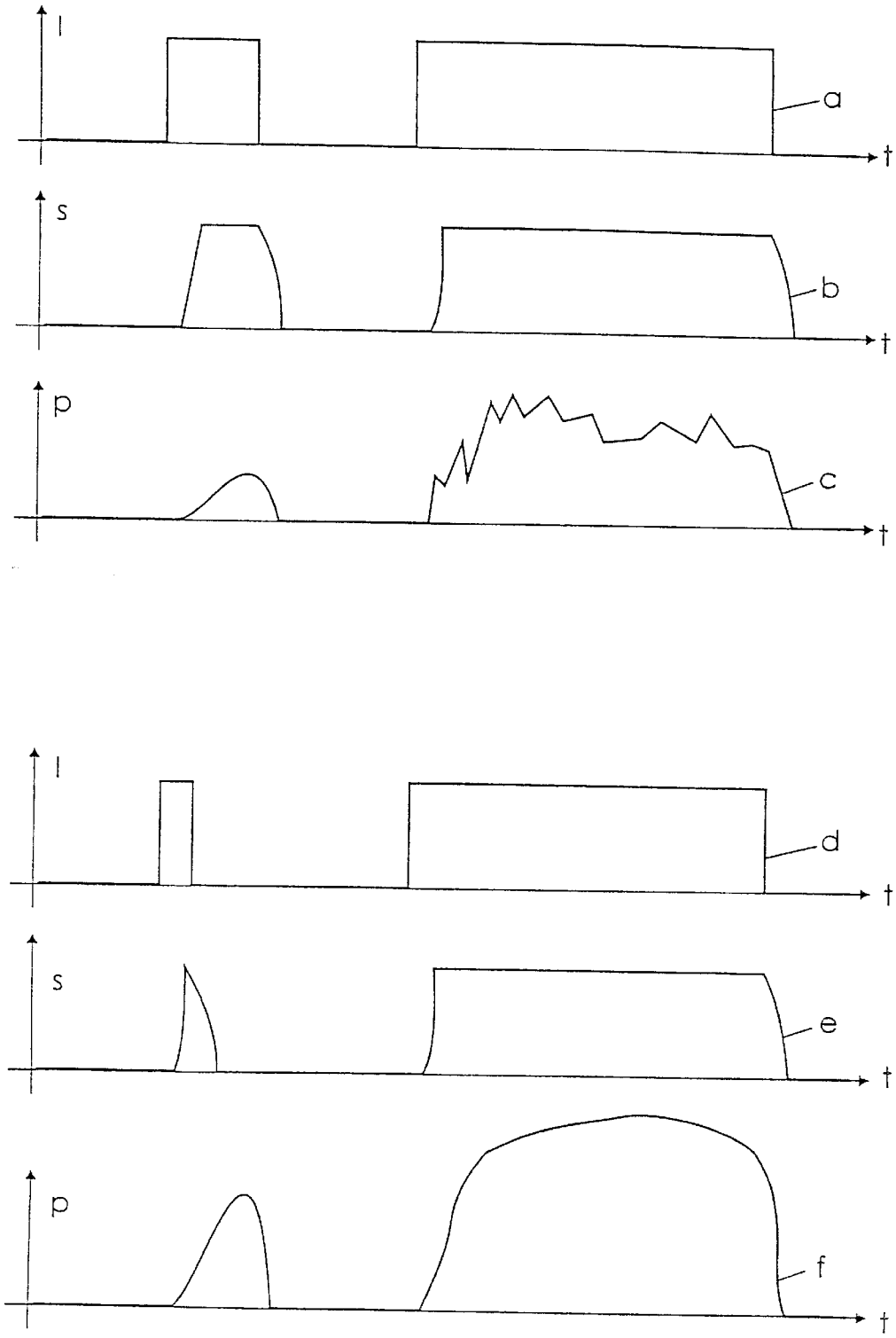
PRIOR ART Fig. 2
FIG. 2 shows the time-dependent injection process with a first fuel injection system according to the state of the art.

FIG. 2 shows a fuel injection curve as it is known in the state of the art. The fuel injection pump used for the injection process includes only a main control valve and no additional control valve. The curves a, b, and c show the fuel injection procedure at engine idle speed over a time period t. In this case, the main control valve in accordance with curve a is first shortly energized by a current I to initiate an initial injection of a small fuel volume. The opening stroke of the control valve is shown by curve b. The control valve is kept closed for a short period and is then again opened for the termination of fuel injection for the initial fuel volume. The curve c shows the fuel pressure at the injection nozzle which is quite irregular.

The curves d to f show the fuel injection procedure with the same fuel injection pump as used in figures a, b, and c at nominal engine speed. Again, the main control valve is energized to close for the injection of an initial fuel volume but for a shorter period of time t so that it closes shortly as shown by curve e and is then opened to terminate the initial fuel injection. As shown by curve f in this case, the pressure p at the injection nozzle and, accordingly, the initially injected fuel volume are relatively high.

For initiating the injection of the main fuel volume, the fuel injection valve is again energized (curves a and d). As indicated by figures b and c, the control valve then closes whereby the fuel pressure p at the fuel injection nozzle is increased and the fuel injection nozzle is opened for the injection of the fuel as it is shown by curve f. The injection of the main fuel volume is terminated by opening, that is by deenergizing, the control valve to cause a collapse of the pressure p at the fuel injection nozzle and the closing of the nozzle.

Figure 3:
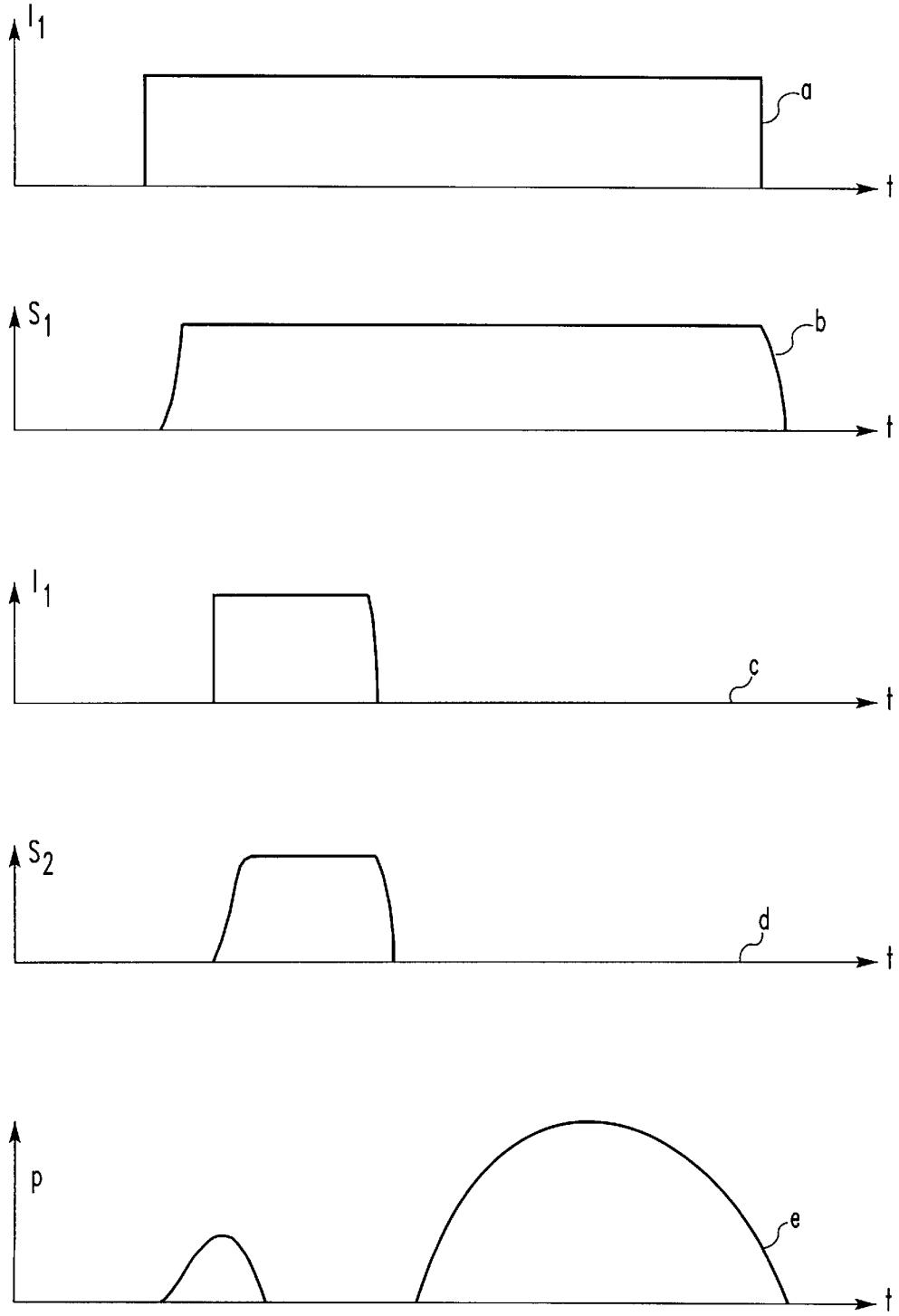
FIG. 3 PRIOR ART
FIG. 3 shows the time-dependent injection process with a second fuel injection system according to the state of the art.

FIG. 3 shows an injection procedure with another fuel injection system as it is known from the state of the art wherein two control valves are used as shown for example in DE 37 22 265 A1. As shown by curves a and b, the main control valve is energized during the whole injection period (a) whereby the valve is closed during that period (b) whereas the additional control valve is shortly energized so as to be opened, as shown by curves c and d, for interrupting fuel injection, that is, to terminate initial fuel injection. To initiate the injection of the main fuel volume, the additional control valve is deenergized whereby it is closed. This procedure is performed in about the same way over the whole engine speed range and results in high fuel injection pressures at the fuel injection nozzle as indicated by curve e, that is, in relatively high initial and main injection volumes.

Figure 4:
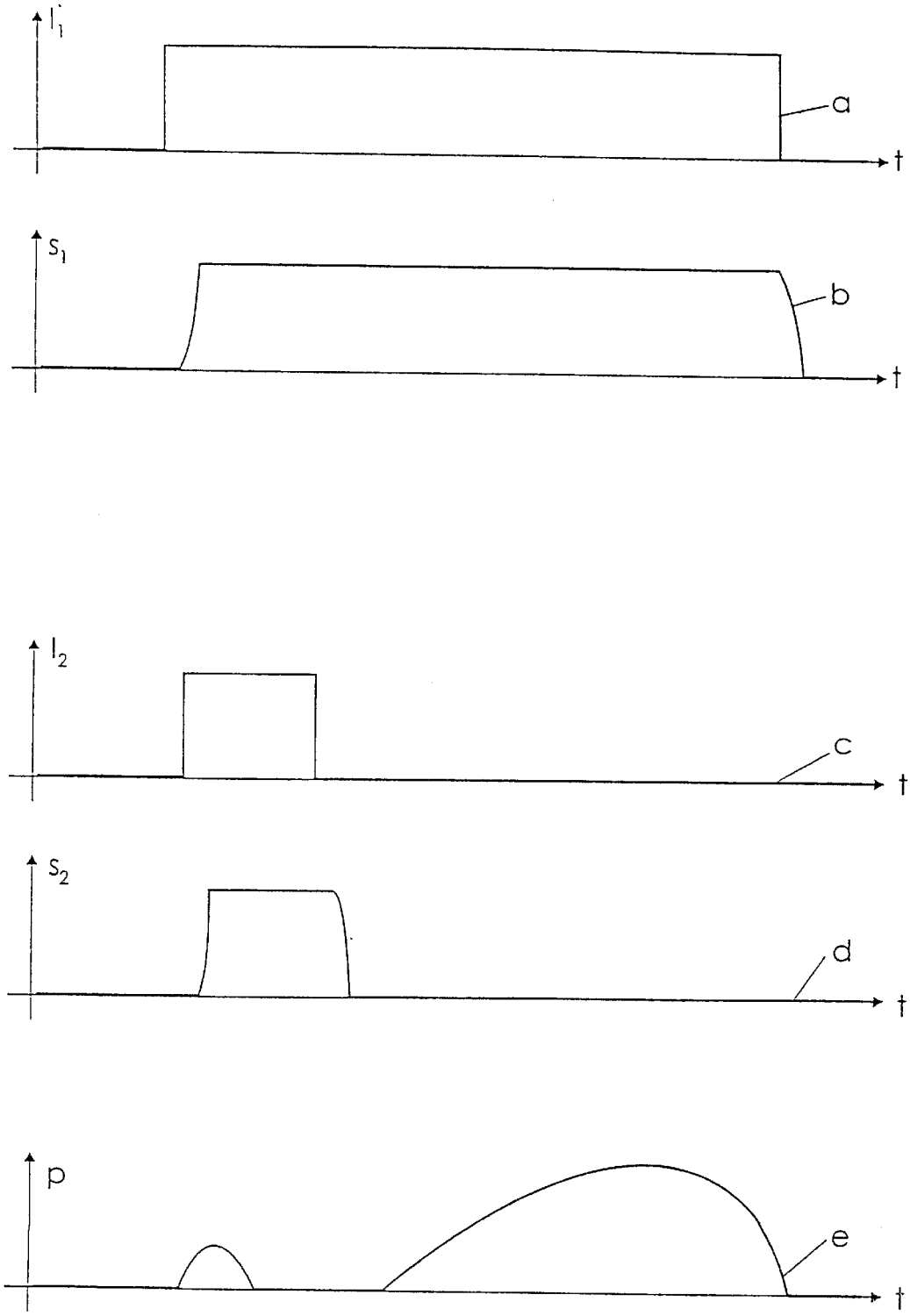
FIG. 4 shows the time-dependent injection process of the fuel injection system according to the invention at low engine speed.

FIG. 4 shows an injection procedure for the injection pump described above with reference to FIG. 1, wherein, at idle and low engine speeds, the procedure is essentially the same as described with reference to FIG. 3. However, by reducing the flow cross-section of the additional control valve 13 excessive pressure release from the high pressure space can be avoided whereby, in accordance with curve e, the pressure p at the fuel injection nozzle is lower than that indicated by the curve of FIG. 3.

Figure 5:
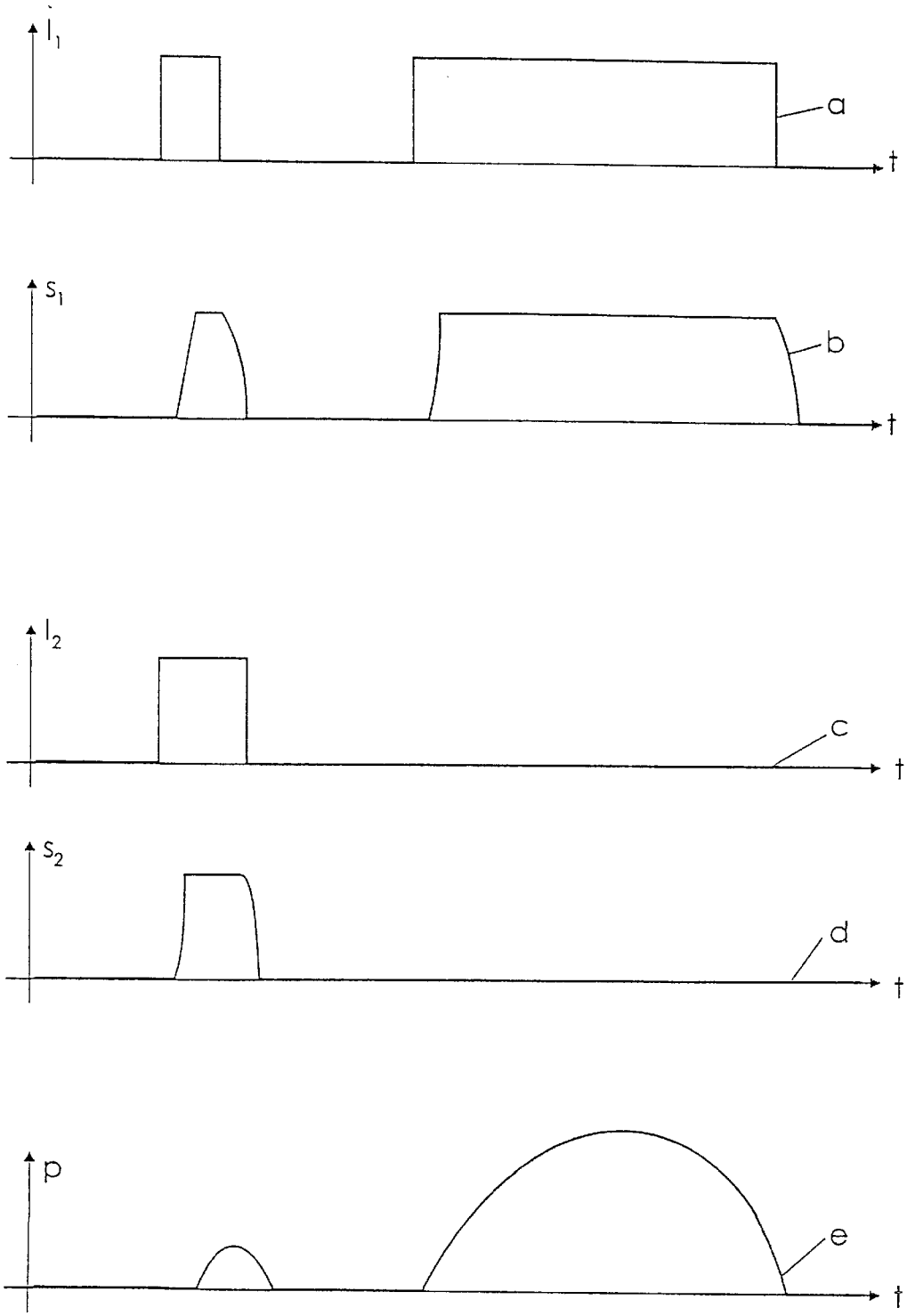
FIG. 5 shows the time-dependent injection process according to the invention in the higher engine speed range.

FIG. 5 shows the fuel injection procedure for the fuel injection pump 1 at higher engine speeds and up to nominal engine speed. In this case, the main control valve is closed for the injection of the initial fuel volume. For the termination of the initial fuel injection, the main control valve 9 is deenergized as shown by curve d, whereby the main control valve 9 is opened. For initiating the injection of the main fuel injection volume, the main control valve is then again energized and consequently closed. During the initial fuel injection, in this case, the additional control valve 13 is energized, that is, it is opened (curves c, d.).

With the energization of the main control valve 9 which is closed thereby and the energization of the additional control valve 13, which is maintained open thereby during initial fuel injection, the energization duration for the main control valve 9 can be increased. With the additional control valve 13 being open, the pressure increase in the high pressure space is reduced as shown by curve e since part of the fuel is permitted to flow back into the passage section lib through the restrictive additional control valve 13.

What is claimed is:

1. A fuel injection system for an internal combustion engine with a fuel injection pump providing for an initial fuel injection and a main fuel injection, said fuel injection pump including a fuel supply passage with a main fuel supply passage section and a side passage, a main fuel control valve disposed in said main fuel supply passage and an additional fuel control valve arranged in said side passage, said fuel injection pump being capable of generating in said main fuel supply passage, a high fuel pressure sufficient to open a fuel injection nozzle for injecting fuel when said main fuel control valve is closed, wherein, at low speeds of the internal combustion engine, the main fuel control valve is maintained closed for initial fuel injection and for the main fuel injection, and, the additional fuel valve is opened for terminating initial fuel injection, and, at high engine speeds, the main fuel control valve is closed during initial fuel injection to generate fuel pressure in the pressure space while the additional control valve is open for a partial release of the fuel from the high pressure space, and the main control valve is opened for full fuel pressure release from the pressure space to terminate initial fuel injection and, after a predetermined interruption, the main control valve is again closed to generate a high pressure sufficient to open the fuel injection nozzle for the main fuel injection.

2. A fuel injection system according to claim 1, wherein the high pressure in said main fuel supply passage of the fuel injection pump is generated by a piston disposed in said pump.

3. A fuel injection system according to claim 1, wherein the closing of said main fuel valve and the opening of said additional fuel valve is effected by energization of control magnets of said control valves.

* * * * *